United States Patent [19]

Takeuchi et al.

[11] 4,170,200

[45] Oct. 9, 1979

[54] INTERNAL COMBUSTION ENGINE WITH REFORMED GAS GENERATOR

[75] Inventors: Yukihisa Takeuchi, Aichi; Kouji Horie, Kariya, both of Japan

[73] Assignee: Nippondenso Co., Ltd., Cichi, Japan

[21] Appl. No.: 841,909

[22] Filed: Oct. 13, 1977

Related U.S. Application Data

[62] Division of Ser. No. 583,763, Jun. 4, 1975, abandoned.

[30] Foreign Application Priority Data

| | | | |
|---|---|---|---|
| Jun. 14, 1974 | [JP] | Japan | 49/68580 |
| Jul. 31, 1974 | [JP] | Japan | 49/88268 |
| Sep. 1, 1974 | [JP] | Japan | 49/100192 |

[51] Int. Cl.[2] ..... F02B 43/08; F02M 13/06

[52] U.S. Cl. ..... 123/3; 48/197 R; 123/127; 123/DIG. 12

[58] Field of Search ..... 123/3, 119 E, DIG. 2, 123/127; 48/197 R; 252/373

[56] References Cited

U.S. PATENT DOCUMENTS

| | | | |
|---|---|---|---|
| 3,650,713 | 3/1972 | Chinchen et al. | 48/197 R |
| 3,717,129 | 2/1973 | Fox | 123/DIG. 12 |
| 3,801,708 | 4/1974 | Smith | 252/373 |
| 3,828,736 | 8/1974 | Koch | 123/3 |
| 3,855,980 | 12/1974 | Weisz et al. | 123/3 |
| 3,898,057 | 8/1975 | Moller et al. | 48/197 R |
| 3,901,197 | 8/1975 | Noguchi et al. | 123/3 |
| 3,915,125 | 10/1975 | Henkel et al. | 123/3 |
| 3,918,412 | 11/1975 | Lindstrom | 123/3 |
| 3,926,850 | 12/1975 | Kostka | 123/3 |
| 3,971,847 | 7/1976 | Houknan | 252/373 |

*Primary Examiner*—Charles J. Myhre
*Assistant Examiner*—David D. Reynolds
*Attorney, Agent, or Firm*—Cushman, Darby & Cushman

[57] ABSTRACT

The invention discloses an internal combustion engine of the type in which alcohol or alcohol-containing mixture and air undergo the thermal or catalytic reforming reaction, and the reformed gases containing hydrogen are directly charged or mixed with gasoline or the like and charged into the engine for combustion. The production of soot and tar during the thermal or catalytic reforming reaction may be minimized, and the emission of noxious combustion products may be also minimized.

10 Claims, 11 Drawing Figures

INTERNAL COMBUSTION ENGINE WITH REFORMED GAS GENERATOR

This is a division, of application Ser. No. 583,763 abandoned filed June 4, 1975.

BACKGROUND OF THE INVENTION

The present invention relates to an internal combustion engine combined with a reformed gas generator for the purpose of minimizing the emission of the noxious combustion products.

In the conventional internal combustion engines combined with a reformed gas generator, the mixture of hydrocarbon fuel such as gasoline, air, water and exhaust gases from the engine is passed through a reactor packed with catalysts and heated at a temperature between 250 and 1,000° C. so that a part of the fuel may be converted into hydrogen and/or carbon monoxide before the combustion mixture is charged into the combustion chambers of the engine. There has been also devised and demonstrated an internal combustion engine of the type in which hydrogen supplied from a hydrogen storage tank is mixed with the hydrocarbon fuel. In the engines of the former type, an independent water tank must be mounted so that there is a fear that the water tank may rupture when water is freezed. When the fuel contains lead compounds, the exhaust gases inevitably contains the lead compounds so that the catalysts are contaminated or poisoned by the lead compounds. Even when the fuel does not contain the lead compounds, soot and tar in the exhaust gases contaminate the catalysts. Therefore in either cases, the catalytic activity is lost. When the fuel is a cyclic hydrocarbon compound such as gasoline, light oil, kerosine and the like or when the hydrocarbon fuel contains gum, soot and tar are deposited upon the surfaces of the catalysts, the inner wall of the reactor and the inner wall of the fuel supply pipe connecting the reactor with the engine so that the catalytic activity is lost and the clogging of the fuel pipe occurs. In the internal combustion engines of the type in which hydrogen is supplied from a hydrogen storage tank, there is a fear that the storage tank might explode itself. Furthermore, the hydrogen storage tanks are, in general, large in size and heavy in weight so that mounting them on the automotive vehicles results very serious economical disadvantages.

SUMMARY OF THE INVENTION

One of the objects of the present invention is therefore to provide an internal combustion engine with a reformed gas generator which may substantially eliminate the difficulties encountered in the conventional internal combustion engines.

Briefly stated, the present invention provides an internal combustion engine combined with a reactor for causing the thermal or catalytic reforming reaction of alcohol or alcohol-containing mixture with air with the utilization of heat thereby converting into reformed gases containing hydrogen, and a reformed gas charging system for charging the reformed gases into the combustion chambers of the engine.

According to the present invention, the problem of aging of the catalysts may be overcome; the use of a hydrogen storage tank large in size and heavy in weight may be eliminated; and the lean combustion mixture in air-fuel ratio considerably lower than the theoretical air-fuel ratio may be satisfactorily burnt in the engine so that the emission of the noxious combustion products may be considerably reduced. According to the present invention, the chemical catalytic process of the hydrocarbon fuel is not carried out in order to produce the reformed gases so that no soot and tar are produced. Therefore, the problems of the contamination of the catalyst and of clogging of the fuel supply pipe by the soot and tar may be eliminated.

DESCRIPTION OF THE PREFERRED EMBODIMENTS

First Embodiment, FIGS. 1 through 5

Figure 2:
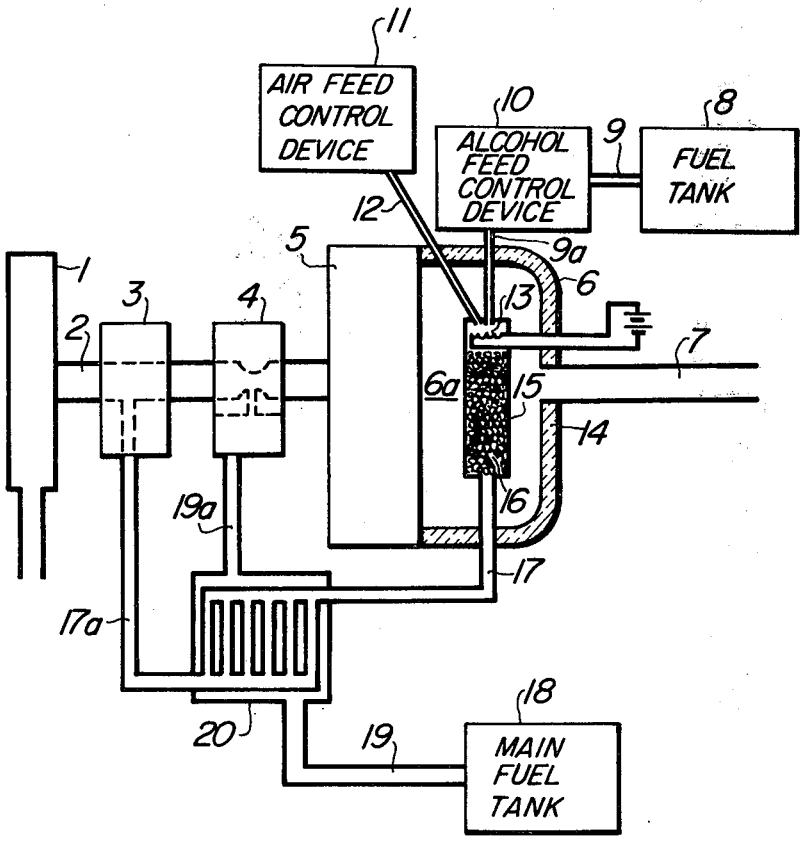
FIG. 2 is a schematic diagram of a first embodiment of the present invention.

Referring first to FIG. 2, an air cleaner 1 is connected to an engine block 5 through an intake pipe 2, a mixing chamber 3 in which the reformed gases are mixed with the intake air, and a carburetor 4. Instead of the carburetor 4, any suitable fuel injection system may be employed. The exhaust gases from the engine block 5 flows into an exhaust gas chamber **6*a* defined by a casing 6 and then into an exhaust pipe 7. A fuel tank 8 containing alcohol or alcohol containing mixture is connected to a reforming reactor 15 through a pipe 9, an alcohol feed control device 10 and a pipe 9*a*. The alcohol feed control device 10 controls the quantity of alcohol or alcohol-containing liquid to be supplied to the reactor 15 in response to the engine operating conditions. An air feed control device 11 is communicated through an air pipe 12 with the reactor 15 in order to charge into the reactor 15 the air the quantity of which is ⅛ to 1/15 of the intake air quantity. At the upper end portion within the reactor 15 is located an electrical ignition or heating device 13 consisting of a nicrome or tantalum wire or a spark or glow plug. The casing 6 is lined with an insulating layer 14 in order to keep the high temperature in the exhaust chamber 6*a*. The reactor 15 is filled with catalyst 16 for accelerating the chemical reaction between air and alcohol. The reaction products or gases from the reactor 15 flow through a pipe line 17 into a heat exchanger 20 in which the heat is exchanged between the reaction products or reformed gases and the main fuel supplied from a main fuel tank 18 through a fuel pipe line 19**.

The ignition or heating device 13 starts the catalytic reforming reaction within the reactor 15 between the air charged through the air feed control device 11 and alcohol or alcohol-containing mixture supplied through the alcohol feed control device 10 so that the reformed gases are produced. The heat generated by the reforming reaction serves to raise the temperature of the catalyst 16 immediately after the engine is started. After the temperature of the exhaust gases rises above 500° C., the catalytic reforming reaction proceeds by the heat of the exhaust gases so that the ignition or heating device 13 may be de-energized.

In the heat exchanger 20, the reformed gases are cooled to a desired temperature while the fuel from the main fuel tank 18 is heated. Therefore, the mixture ratio between the reformed gases and intake air may be maintained constant, and the atomization and evaporation of the fuel from the main fuel tank 18 may be much facilitated. The reformed gases flow from the heat exchanger 20 through a pipe 17*a* into the mixing chamber 3 where the reformed gases are mixed with the intake air. The main fuel flows from the heat-exchanger 20 through a fuel pipe 19*a* into the carburetor 4 in such a quantity that the air-fuel ratio lower than the stoichiometric ratio may be obtained. The combustion mixture consisting of the main fuel, the reformed gases and the air is charged into the engine block 5 for combustion.

When the volumetric ratio between the main fuel or gasoline and the reformed gases in terms of methanol is, for instance, 1:5, the stable combustion may be ensured even when the air-fuel ratio of gasoline is higher than 20 (1.3 in terms of the excess air ratio). The engine output reduction is negligible, and even immediately after the engine is started, the contents of noxious combustion products such as nitrogen oxides, carbon monoxide, hydrocarbons and so on in the exhaust gases are considerably reduced. The ratio between the reformed gases in terms of methanol and gasoline may be reduced as low as 1:8, but it is preferable to change this ratio depending upon the air-gasoline ratio.

Table 1 below shows the composition of the products of the catalytic reforming process in the reactor 15.

Table 1

| Alcohol | Air cc/min. | Reformed gases cc/min. | Composition in % (cc/min.) Hydrogen | Nitrogen | Carbon monoxide | Methane | Carbon dioxide | Residue | Water cc/min. |
|---|---|---|---|---|---|---|---|---|---|
| Methanol | 100 | 305 | 45.0% 137 cc/min. | 26.2% 80 cc/min. | 20.1% 61 cc/min. | 2.9% 9 cc/min. | 5.7% 17 cc/min. | 0.03% 1 cc/min. | 0.015 |
| Ethanol | 100 | 305 | 20.9% 48 cc/min. | 34.8% 80 cc/min. | 16.9% 39 cc/min. | 9.1% 21 cc/min. | 6.9% 16 cc/min. | 20.4% 47 cc/min. | 0.013 |

Reaction Conditions:
Temperature : 500° C
Catalyst : Pt - $Al_2O_3$
Alcohol Feed: 0.15 cc/min.

The laboratory experiments showed that the composition of the products of the catalytic reforming process remains almost same.

As the catalyst 16, any conventional catalysts containing oxides of Pt, Pd, Ni, Co, Fe, Cu, Or, Au and so on or the so-called ceramic compounds such as $Al_2O_3$, $SiO_2$, MgO, CaO and the like. However, depending upon the catalyst used, the composition of the product of the catalytic reforming process, the volume thereof, the temperature at which the catalytic reforming process may proceed in a stable manner, and the quantity of soot produced are different slightly. The most effective catalysts are platinum- and nickel-containing catalysts. The catalytic reforming reaction proceeds at a temperature higher than 250° C., but the reaction temperature is preferably 300° C. to 700° C. because the reformed gases must pass through the heat-exchanger 20 to give their heat to gasoline in order to facilitate the atomization and evaporation thereof. Because of the energy loss, the air feed to the reactor 15 is preferably about 100 cc/min. that is, about 10% of the air quantity required for the stoichiometric combustion of alcohol in order that the reformed gases in desired composition may be produced.

Figure 5:
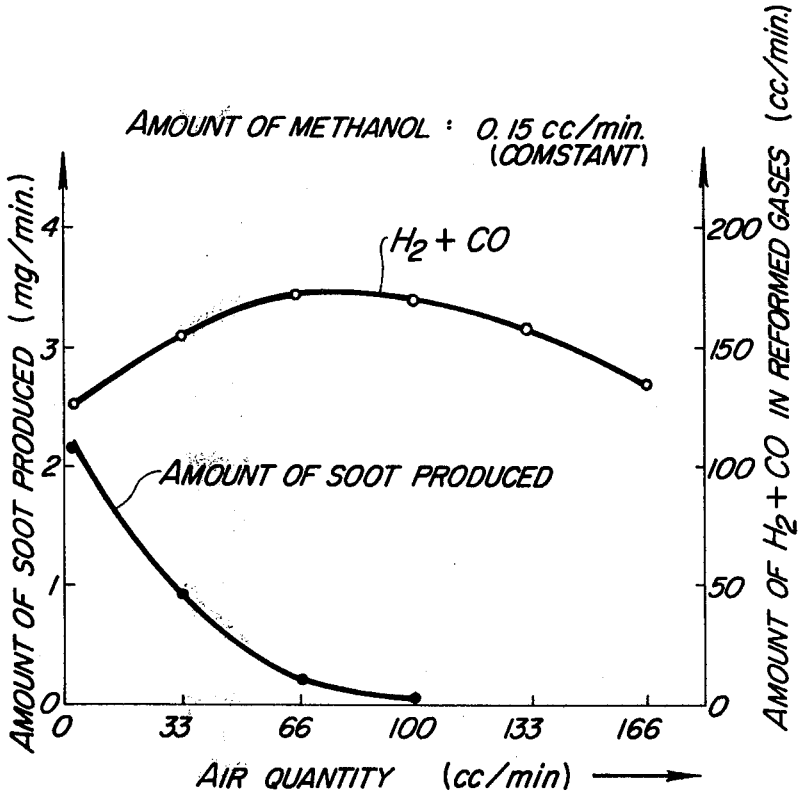
FIG. 5 shows a graph illustrating the relationship among the air quantity fed into a reforming reactor, the amount of hydrogen and carbon monoxide produced by the reforming reaction, and the amount of soot produced.

From Table 1, it is seen that the use of methanol is most advantageous because hydrogen and carbon monoxide are produced in large quantity. Furthermore, there is another advantage in that almost no soot and tar deposit on the catalysts. When ethanol undergoes the catalytic reforming process, in addition to hydrogen, carbon monoxide and methane, various compounds having a higher number of carbon atoms such as ethane, ethylene, acetylene, propylene and the like are produced, and soot is attached to the catalyst even though in a very small quantity. In order to reduce the reaction products having a higher number of carbon atoms, the air feed may be increased up to 15% of the air quantity required for the stoichiometric combustion of alcohol, but the increase over 15% is not preferable because the energy loss is considerably increased for the practical purpose. In summary, the air feed quantity must be so selected that almost no soot may be attached to the catalyst. Most preferably the air feed quantity is about 15% in weight of the air quantity required for the stoichiometric combustion of methanol as shown in FIG. 5. In FIG. 5, air feed is 100 cc/min. for alcohol feed of 0.15 cc/min. When the energy loss is taken into consideration, the catalytic reforming reaction is expressed as follows:

$$CH_3OH + 0.225O_2 + 0.90N_2 + 120\ \text{Kcal/Mol} \xrightarrow{Pt} 0.90N_2 + 1.65H_2 + 0.70CO + 0.10CH_4 + 0.15H_2O + 0.20CO_2$$

This is an endothermic reaction absorbing heat of 120 Kcal/Mol. When the air feed is increased beyond 15%, the exothermic reaction takes place, resulting in the reduction of hydrogen and carbon monoxide.

Water produced by the catalytic reforming reaction and charged into the combustion chambers not only reduce the temperature in the combustion chambers but also serves to reduce the formation of nitrogen oxides. However, care should be taken that a large quantity of water may not be produced because it causes the erosion of the engine and reduces the engine output.

Table 2 shows the composition of the products of the catalytic reforming reaction of (a) the mixture of 80% of methanol and 20% of water, (b) the mixture of 86% of methanol, 7% of water and 7% of hydrocarbon and (c) the mixture of 50% of methanol and 50% of hydrocarbon.

Table 2

| Mixture | Composition in % Methanol | Water | Hydrocarbon | Air feed cc/min. | Reformed gas cc/min. | Composition in % and cc/min. $H_2$ | $N_2$ | CO | $CH_4$ | $CO_2$ | $C_2H_4$ | Residue |
|---|---|---|---|---|---|---|---|---|---|---|---|---|
| a | 80 | 20 | — | 100 | 24.5 | 37.0% 91 cc/min | 33.5 80 | 13.5 33 | 10.5 26 | 4.5 11 | 0.5 1 | 1.5 4 |
| b | 86 | 7 | 7 | 100 | 30.0 | 52.0% 157 cc/min. | 36.5 80 | 16.0 48 | 4.5 13 | 1.0 2 | — — | — — |
| c | 50 | — | 50 | 100 | 22.0 | 37.0% 81 cc/min. | 36.0 80 | 17.5 39 | 3.3 4 | 7.0 1.5 | — 0.5 | 1.0 2.5 |

Figure 1:
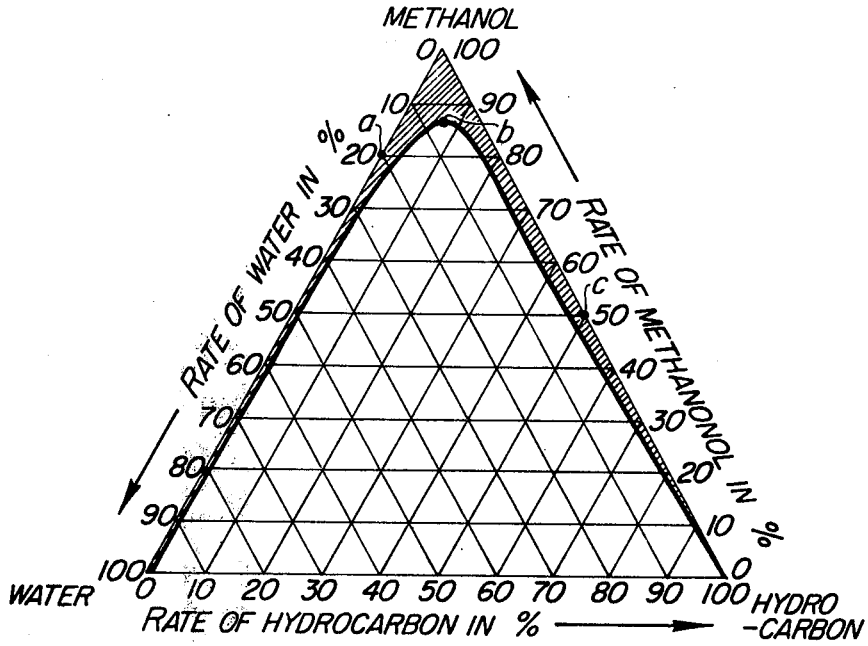
FIG. 1 is a solubility diagram of methanol, water and hydrocarbon used in the internal combustion engine in accordance with the present invention.

In these mixtures (a), (b) and (c), water, methanol and hydrocarbon are not separated from each other and well mixed as shown in the hatched area of the solubility diagram shown in FIG. 1. The hydrocarbon used has the composition similar to that of the ordinary gasoline, and its cyclic hydrocarbon compound (especially aromatic compounds) and gum contents are very small (less than 2 to 3%). From Table 2 it is seen that the volume of hydrogen, carbon monoxide and methane produced by the catalytic reforming reaction of the mixture (b) is largest and that the higher the content of methanol, the larger the volume of hydrogen, carbon monoxide and methane produced becomes. As compared with other hydrocarbon compounds, hydrogen and carbon monoxide serve to facilitate the combustion of the lean mixture so that the higher the contents of hydrogen and carbon monoxide, the better.

Table 3 below shows the composition of the product of the catalytic reforming reaction of the mixture consisting of methanol and gasoline.

Table 3

| Composition in % Methanol | Gasoline | Air Feed cc/min. | Reformed gases cc/min. | Composition in % in upper column Hydrogen | Nitrogen | Carbon monoxide | Composition in in lower column Methane | dioxide | Residue | Soot and tar |
|---|---|---|---|---|---|---|---|---|---|---|
| 80 | 20 | 100 | 245 | 37.0 91 | 33.5 80 | 13.5 33 | 10.5 26 | 4.5 11 | 2.0 5 | Extremely small quantity |
| 70 | 30 | 100 | 210 | 28.5 38.0 60 | 10.5 80 | 12.5 23 | 6.0 26 | 4.5 13 | 9 | Extremely small quantity |
| 65 | 35 | 100 | 190 | 24.0 46 | 42.0 80 | 8.0 15 | 13.0 23 | 5.5 10 | 7.5 14 | Catalytic activity was lost |

Reaction Conditions
Temperature: 500° C.
Catalyst: Pt-$Al_2O_3$
Mixture Feed: 0.15 cc/min.

The higher the content of gasoline, the larger the amount of soot and tar produced by the cracking of gasoline and attached on the catalyst becomes so that the catalytic activity is lost. Therefore, the maximum allowable mixture ratio between methanol and gasoline is 7:3. Within this ratio, even when 2% in volume of water in the atmosphere is absorbed by methanol, methanol and gasoline will be separated from each other into two layers.

Figure 3:
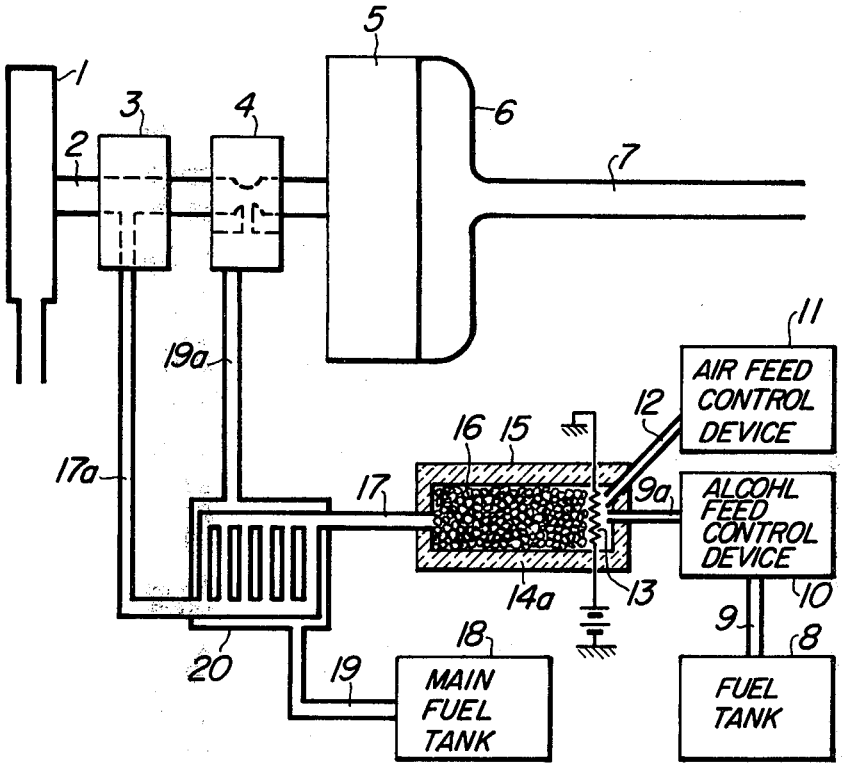
FIG. 3 is a schematic diagram of a first modification of the first embodiment.

Next referring to FIG. 3, one modification of the first embodiment will be described. The construction is substantially similar to that of the first embodiment except that the catalytic reforming reaction proceeds not by the heat of the exhaust gas but by the heat generated by the ignition or heating device 13. This construction has an advantage in that the reactor 15 may be located in a position remote from the engine block so that the damages to the catalyst due to the vibration of the engine block may be prevented.

Figure 4:
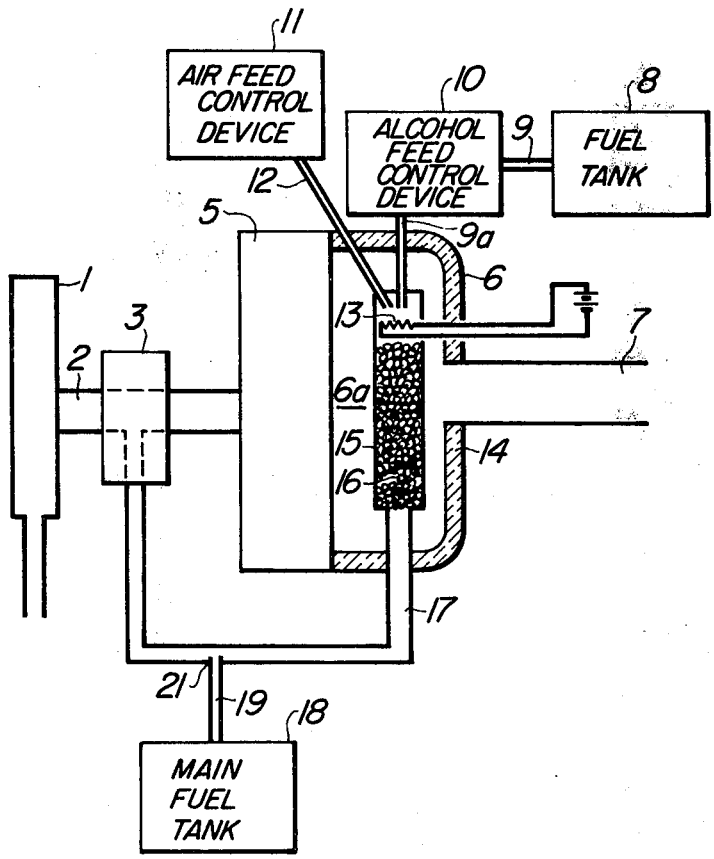
FIG. 4 is a schematic diagram of a second modification of the first embodiment.

Another modification of the first embodiment shown in FIG. 4 is also substantially similar in construction to the first embodiment shown in FIG. 2 except that gasoline is directly injected into the reformed gases by gasoline injecting means 21. This modification has a distinct advantage over the first embodiment in that the heat exchanger 20 may be eliminated so that the engine space may be considerably reduced.

So far the main fuel has been described as being gasoline, but it is to be understood that other fuels such as hydrocarbons, alcohol, ether, ketone, hydrogen, amonia-series hydrocarbon and the like may be used individually or as a mixture.

The alcohol feed control device 10 is disclosed in detail in laid open Japanese Patent Application No. 12659/72, corresponds to Eckert U.S. Pat. No.

3,728,993 and controls the feed of alcohol or alcohol-containing mixture to the reactor 15 depending upon the operating conditions of the engine. The air feed control device 11 may consist of an air pump and a control valve whose opening is controlled in response to the operating conditions of the engine. Thus, the mixture of air and alcohol or alcohol-containing mixture in a predetermined ratio may be fed into the reactor 15.

Figure 6:
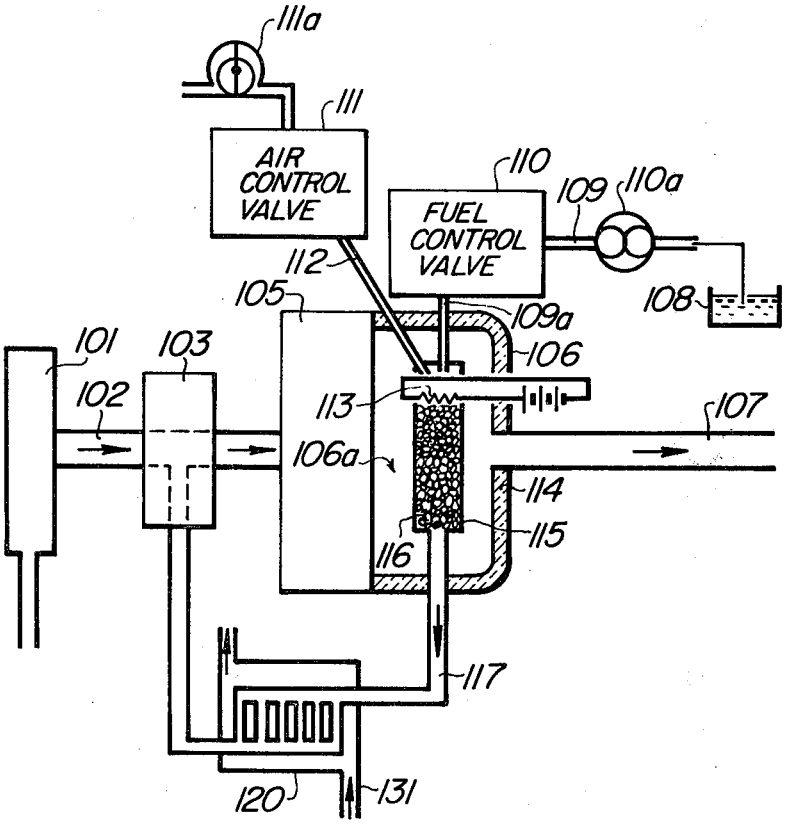
FIG. 6 is a schematic diagram of a second embodiment of the present invention.

Second Embodiment, FIG. 6

The second embodiment of the present invention shown in FIG. 6 is substantially similar in construction to the first embodiment except that the carburetor 4 of the first embodiment is eliminated. An air cleaner 101 is communicated an engine block 105 through an air intake pipe 102 and a mixing chamber 103 where the reformed gases are mixed with the intake air. The exhaust gases from the engine block 105 flows through an exhaust chamber 106*a* defined by a casing 106 into an exhaust pipe 107. The casing 106 is lined with an insulating material 114 to prevent the dissipation of heat through the casing wall. Within the exhaust gas chamber 106*a* is disposed a reactor 115 packed with catalyst 116 and provided with an electrical ignition or heating device 113 consisting of an ignition plug or nicrome or tantalum wire in order to burn a part of alcohol or alcohol-containing mixture fed into the reactor 115, thereby raising the temperature of the catalyst 116 when the engine is started. A fuel control valve 110 is provided in order to control the feed of alcohol to the reactor 115, and is communicated through a fuel line 109 and a fuel pump 110*a* with a fuel tank 108 and through a fuel pipe 109*a* with the reactor 115. An air control valve 111 for controlling the air feed to the reactor 115 is interposed between air feed pipes 111 and 112 communicating an air pump 111*a* with the reactor 115. The reformed gases produced in the reactor 115 by the catalytic reforming reaction flows through a reformed gas pipe 117 into a heat exchanger 120 where the heat exchange is effected between the reformed gases and water or air fed into the heat exchanger in the direction indicated by the arrow 131.

Next the mode of operation of the second embodiment with the above construction will be described. Both the air and alcohol or alcohol-containing mixture feed to the reactor 115 are controlled by the air and fuel control valves 111 and 110, respectively, depending upon the operating conditions of the engine. In the reactor 115, the catalytic reforming reaction between air and alcohol or alcohol-containing mixture proceeds by the heat from the exhaust gases with the aid of the catalyst 116 so that the reformed gases containing a large amount of hydrogen may be produced. The reformed gases flows through the reformed gas pipe 117 into the heat exchanger 120 where they are cooled to a temperature of the order of 100° C. (a temperature higher than a point at which the reformed gases are liquefied). The cooled reformed gases flow into the mixing chamber 103 where they are mixed with the intake air from the air cleaner 101, and the combustion mixture is charged into the engine block 115 for combustion.

When the engine is started, the temperature of the catalyst 116 is low so that a part of a alcohol and air charged into the reactor 115 is burnt by the ignition or heating device 113 to heat the catalyst 116 to a temperature at which the catalytic reforming reaction between air and alcohol or alcohol-containing mixture may be started. Therefore the ignition or heating device 113 is energized only at the starting of the engine as a principle, but it may be energized at any time during the operation of the engine in order to ensure the stable catalytic reforming reaction.

As the catalyst 116, any of the catalysts of the types described elsewhere with reference to the first embodiment may be used.

The exhaust gas chamber 106*a* which is lined with the insulating layer 114 is provided in order not only to heat the reaction chamber by the exhaust gases but also to burn the unburned hydrocarbon compounds contained in the exhaust gases.

The lean mixture of the reformed gases and air may be charged into the cylinders so that the content of the noxious gases in the exhaust gases may be considerably reduced. When the reformed gases are burnt in the so-called stratified combustion engine, the emission of the noxious compounds may be further reduced. In this case, the relatively rich mixture of the reformed gases and air is charged into a trap chamber of the engine where an ignition plug is mounted and the relative lean mixture is charged into a main combustion engine. Alternatively, the rich combustion mixture consisting of the reformed gases and air may be charged to the trap chamber and the lean mixture consisting of the air and the hydrocarbon fuel such as gasoline, light oil, alcohol or the like may be charged into the main combustion chamber.

The reformed gases have the higher chemical energy than alcohol or alcohol-containing mixture, and the chemical energy of the fuel may be increased by the effective use of the heat of exhaust gases. The satisfactory combustion of the lean mixture of reformed gases and air may be ensured. Therefore, the thermal efficiency of the engine in accordance with the present invention may remarkably increased as compared with the conventional internal combustion engines.

Figure 7:
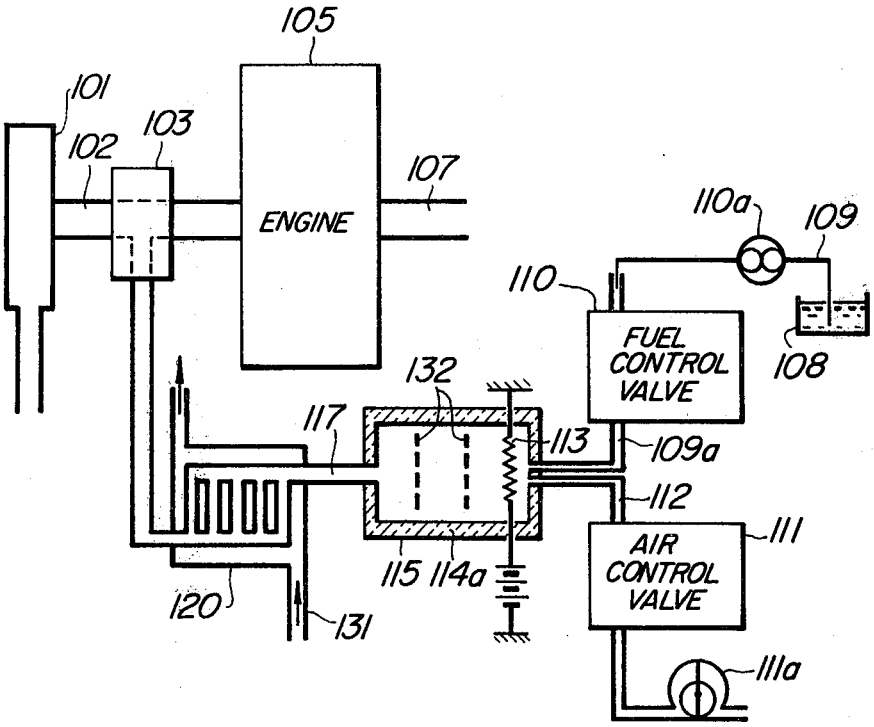
FIG. 7 is a schematic diagram of one modification thereof.

The modification of the second embodiment shown in FIG. 7 is substantially similar in construction to the second embodiment except that the reactor 115 is so arranged that the thermal reforming reaction may be effected without using the catalyst. In order to prevent the dissipation of heat from the reactor 115, the latter is lined with an insulating layer 114*a*, and heater plates 132 are placed within the reactor 115 in order to proceed the thermal reforming reaction. More particularly, a part of alcohol or alcohol-containing mixture fed into the reactor 115 through the fuel control valve 110 is burnt in order to generate the heat for proceeding the thermal reforming reaction. The reformed gases produced are charged into the cylinders for combustion in a manner substantially similar to that of the second embodiment.

Third Embodiment, FIGS. 8 through 11

Figure 8:
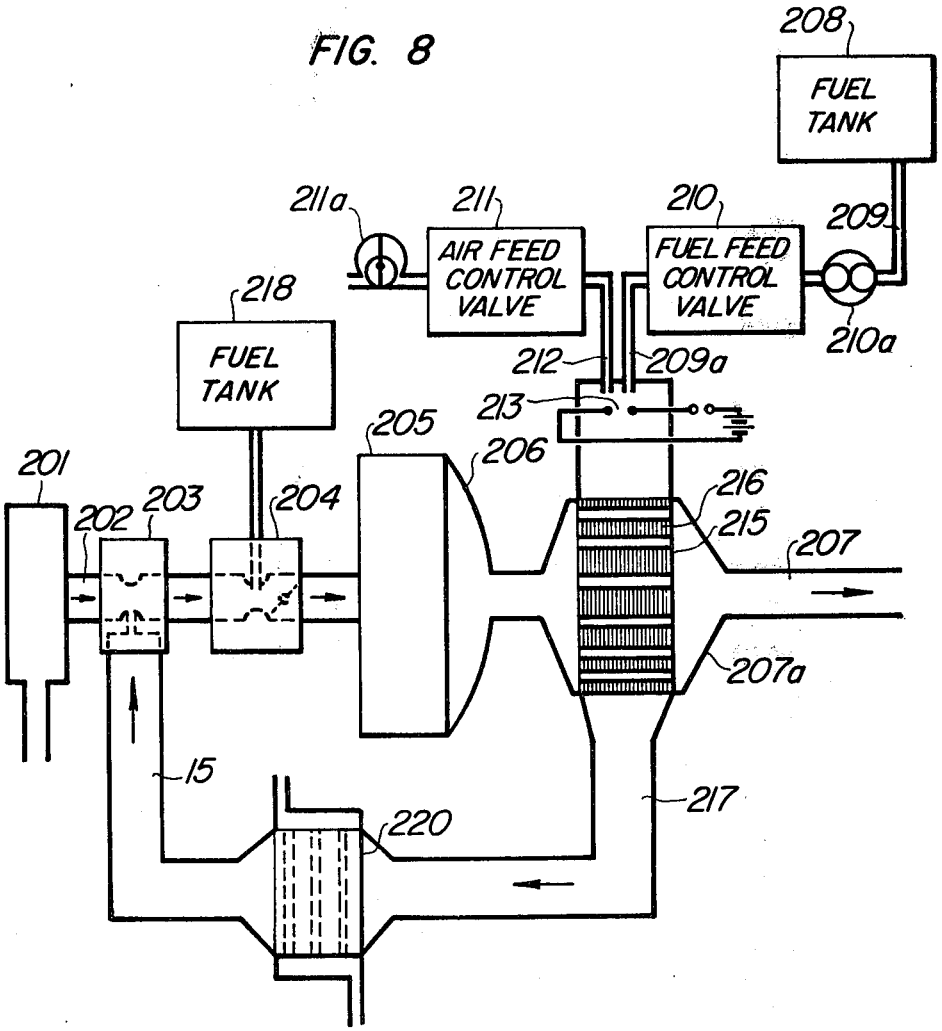
FIG. 8 is a schematic diagram of a third embodiment of the present invention.

The third embodiment of the present invention shown in FIG. 8 is substantially similar in construction to the second embodiment. An air cleaner 201 is communicated through an intake pipe 202, a mixing chamber 203 and a carburetor 204 with the engine body 205. A reactor 215 is located within an enlarged section of an exhaust pipe 207 and is provided with an electrical ignition or heating device 213. Alcohol or alcohol-containing mixture is charged into the reactor 215 from a fuel tank 8 through a pipe 209, a fuel pump 210*a*, a fuel feed control valve 210 and a pipe 209. In like manner, air is charged into the reactor 215 from an air pump 211*a*, an air feed control valve 211 and an air feed pipe 212. The reformed gases produced in the reactor 215 flows through a reformed gas pipe 217 into a heat exchanger 220 where they are cooled to a suitable temperature.

Figure 9:
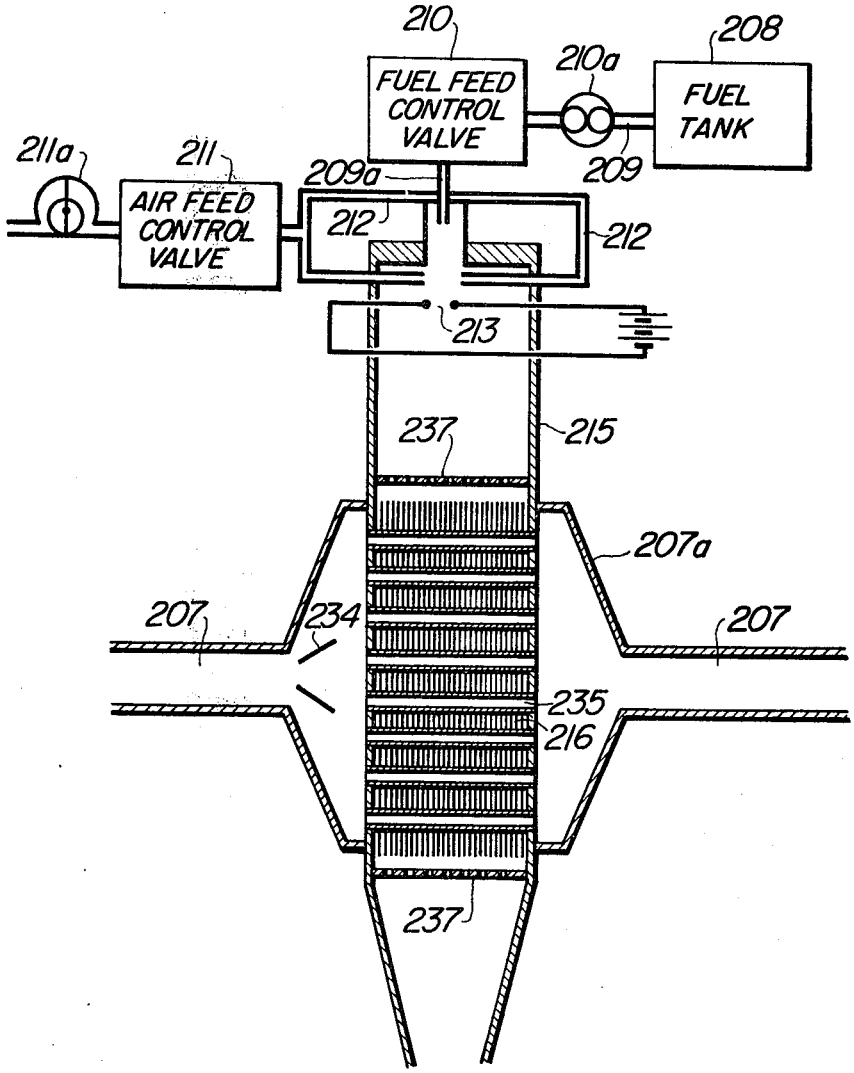
FIG. 9 is a detailed view, on enlarged scale, of a reactor thereof.

FIG. 9 shows a schematic sectional view, on enlarged scale of the reactor 215 packed with many catalyst unit 216, and mounted within the enlarged diameter section 207*a* of the exhaust pipe 207. deflector plates 234 are placed at the intake port of the enlarged-diameter section 207*a* so that the heat from the exhaust gases may be suitably distributed over the reactor 215.

Figure 10:
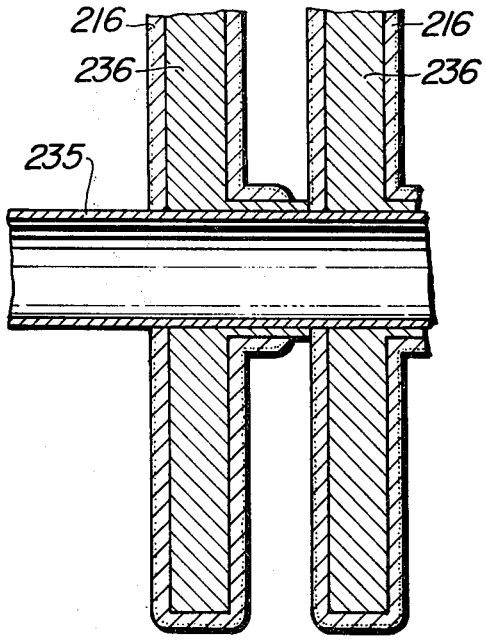
FIG. 10 is a fragmentary view, on still enlarged scale, thereof.
Figure 11:
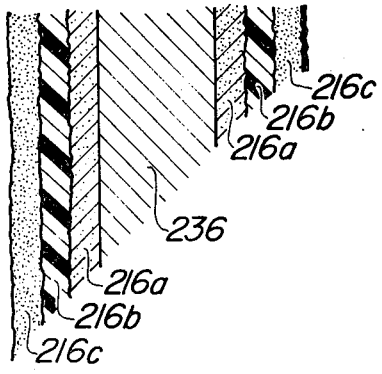
FIG. 11 is a schematic diagram, on further enlarged scale, of part of a catalyst unit thereof used for the construction thereof.

A plurality of pipes 235 are extended through the reactor 215 in the axial direction of the exhaust pipe 207 and are vertically spaced apart from each other by a suitable distance. As shown in FIG. 10, a large number of fin-shaped metal carriers 236 made of stainless steel or iron are attached to the outer surface of each pipe 235. In order to ensure the adhesion between the carrier 236 and ceramics 216*b*, metal powder 216*a* is fused and applied over the surface of the carrier 236, and then ceramics 216*b* is fused and applied over the metal powder coating 216*a* as best shown in FIG. 11. When the carriers 236 are made of stainless steel, nickel-chlomium powder is used, but when the carriers 236 are made of iron, iron powder is used. If the satisfactory adhesion between the carriers 236 and ceramics 216*b* is attained, the coating of the metal powder 216*a* is not required. Over the ceramics layer 216*b* is applied a layer of ceramics such as γ-alumina having a large relative surface area, and thereafter catalyst 216*c* is impregnated. Thus, a catalyst unit 216 is provided. Preferably the ceramics layer 216*b* consists of heat resisting oxide such as alumina, silica, zirconia, magnesia or the like having a thermal expansion coefficient similar to that of the carrier 236 so that the catalyst unit 216 may sufficiently withstand the thermal stresses due to heating and cooling.

The mode of operation of the third embodiment with the above construction is substantially similar to that of the first and second embodiments. The alcohol feed to the reactor 215 is controlled by the fuel control valve 210, and the air feed is controlled by the air feed control valve 211 (The air quantity is about 1/6 of the air quantity required for the theoretical combustion of alcohol). A part of alcohol fed into the reactor 215 is burnt by the ignition device 213 to heat the catalyst units 216 to a temperature at which the catalytic reforming reaction proceeds. The exhaust gases are suitably deflected by the deflector plates 234 and flow through the pipes 235 so that the carriers 236 and hence the catalyst units 216 may be very effectively heated. After the catalyst units 216 have been raised to a suitable temperature, the ignition device 213 is de-energized.

The reformed gases produced in the reactor 215 flow into the heat exchanger 228 and cooled. The cooled reformed gases are mixed with the intake air in the mixing chamber 203, and then with the conventional fuel in the carburetor 204. The combustion mixture is charged into the engine body 205 for combustion. Since the reformed gases contain hydrogen, the combustion of the relatively very lean combustion mixture may be ensured and the emission of the noxious gases or compounds may be minimized.

The reformed gases may be mixed in the carburetor with any suitable fuels such as gasoline, light oil, kerosin, diesel oil, keton, alcohol and the like. Alcohol to be reformed may be methanol, ethanol, propyl alcohol and other low alcohol. In addition to alcohol, the mixture of alcohol with gasoline, kerosin, light oil, diesel oil and the like may be used.

Next the method for fabricating the catalyst unit 216 will be described. The metal carrier 236 is made of stainless steel SUS 430, and the layer of nickel-chromium powder is formed upon the carrier 236 by the fused-flame-spray process. Thereafter the layer of alumina is formed by the fused-flame-spray process. The metal carrier 236 thus coated is immersed for five to 10 minutes in the aqueous solution of alimina and ethyl silicate, which is a binder, in the vacuum atomsphere in order to remove the air bubbles. Thereafter the carrier 236 is dried for two hours at a temperature between 150° and 200° C., and then sintered for 1.5 to 2 hours at a temperature higher than 400° C. so that γ-alumina may be deposited upon the alumina layer. The above step is cycled for a few times. Therefore, the carrier is immersed in 0.5-mol solution of ferric nitrate in the vacuum atmosphere in order to remove the air bubbles and the impregnate iron. Thereafter the carrier is dried at 110° C., and then sintered for two hours at 600° C. so that iron may be oxidized. Next the impregnation, drying and sintering steps are carried out first with the use of the solution consisting of 2.5 mol of nickel nitrate and 1.5 mol of chromium trioxide and then with the use of the solution consisting of 1.5 mol of copper nitrate and 2.5 mol of nickel nitrate. Thus the Fe-Ni-Cr-Cu series catalyst can be deposited upon the γ-alumina layer.

The catalytic reforming reaction of methanol can be started at 150° C. with the catalyst unit 216 of the type described, and is most effective at about 300° C. By the catalytic reforming reaction of 1 mol of methanol, 1.4 to 1.5 mol of hydrogen and 0.7 to 0.8 mol of carbon oxide may be produced as shown below:

$$CH_3OH+0.100_2+0.40N_2+Q\rightarrow 0.40N_2+1.45H_2+-0.70CO+0.15\ OH+0.20H_2O+0.15CO_2$$

According to the present invention, the deposition of soot and tar on the catalyst units is very small, and the catalyst units have sufficient strength and higher thermal conductivity and exhibit excellent catalytic activity. Therefore, the catalytic units in accordance with the present invention are best adapted to be mounted on the internal combustion engines in order to reduce the noxious emission.

What is claimed is:

1. A process for reforming a gas in an internal combustion engine comprising:

a combustion chamber;

an intake pipe communicating with said combustion chamber;

an exhaust gas chamber for receiving exhaust gases from said combustion chamber and leading the same to the atmosphere;

a fuel reforming apparatus communicating with said intake pipe for supplying a reformed gas thereto; and, a reactor means having a catalyst therein for converting a mixture of an alcohol and air into a reformed gas containing hydrogen, said process employing both an alcohol fuel and a hydrocarbon fuel and being carried out without mixing the exhaust gas with the fuel, said process comprising:

feeding an alcohol to said reactor means;

feeding air to said reactor means at a rate of 10 to 15% by weight of the air required for stoichiometric combustion of the alcohol fed to said reactor means, thereby to assure partial oxidation of the alcohol in said reactor means and form said reformed gas containing hydrogen;

feeding a hydrocarbon fuel to said intake pipe;

feeding said reformed gas to said intake pipe;

feeding air to said intake pipe; and feeding said mixture of hydrocarbon fuel, reformed gas and air to said combustion chamber.

2. The process of claim 1 wherein the alcohol is methanol or ethanol.

3. The process of claim 1 wherein the alcohol is methanol.

4. The process of claim 1 wherein the alcohol is methanol or ethanol and the hydrocarbon fuel is a gasoline containing fuel.

5. The process of claim 4 including the step of passing the reformed gas and the gasoline containing fuel through a heat exchanger prior to the intake pipe to lower the temperature of the reformed gas and facilitate the atomization and evaporation of the gasoline fuel.

6. The process of claim 4 comprising adjusting the volumetric ratio of the reformed gas calculated in terms of methanol with respect to the gasoline fuel to from $\frac{1}{8}$ to 5:1 and adjusting the air-fuel ratio of the mixture of the gasoline containing fuel and air to above 20.

7. The process of claim 4 wherein the reformed gas contains at least 20.9% by volume of hydrogen.

8. The process of claim 4 comprising feeding to said reactor means $\frac{1}{3}$ to 1/15 of the total quantity of air charged into said combustion chamber.

9. The process of claim 8 comprising employing methanol as the alcohol, adjusting the volumetric ratio of the reformed gas calculated in terms of methanol with respect to the gasoline fuel to from $\frac{1}{8}$ to 5:1, adjusting the air-fuel ratio of the mixture of the gasoline containing fuel and air to above 20 and heating the reactor means by heat from the exhaust gases.

10. The process of claim 1 wherein there is fed to said reactor means methanol or a mixture of methanol and water, the amount of water being not over 20% of the total of methanol and water.

* * * * *